US006829875B2

(12) United States Patent
Willstumpf

(10) Patent No.: US 6,829,875 B2
(45) Date of Patent: Dec. 14, 2004

(54) METHOD OF VENTING A FILLED BOTTLE WHICH IS CLOSED BY MEANS OF AN ELASTIC STOPPER, AND APPARATUS FOR IMPLEMENTING THE METHOD

(75) Inventor: Erich Willstumpf, Wetter (DE)

(73) Assignee: Aventis Behring GmbH, Marburg (DE)

( * ) Notice: Subject to any disclaimer, the term of this patent is extended or adjusted under 35 U.S.C. 154(b) by 0 days.

(21) Appl. No.: 10/385,619

(22) Filed: Mar. 12, 2003

(65) Prior Publication Data

US 2003/0221395 A1 Dec. 4, 2003

(30) Foreign Application Priority Data

Mar. 13, 2002 (DE) ..... 102 11 226

(51) Int. Cl.[7] ..... B65B 31/00; B65B 7/28

(52) U.S. Cl. ..... 53/432; 53/489; 53/510; 53/264; 53/315; 53/320; 53/321; 53/324

(58) Field of Search ..... 53/405, 432, 485, 53/487–489, 79, 510, 264, 265, 290, 315, 319–321, 324–327

(56) References Cited

U.S. PATENT DOCUMENTS 2,840,970 A 7/1958 Brown
2,849,848 A * 9/1958 Ravin ..... 53/321
3,855,749 A * 12/1974 McMickle, Jr. ..... 53/319
5,083,416 A * 1/1992 Schneider et al. ..... 53/489
5,519,984 A 5/1996 Beussink et al.

FOREIGN PATENT DOCUMENTS

CH 182349 2/1936
FR 2 734 253 A1 11/1996

OTHER PUBLICATIONS

European Search Report dated Aug. 18, 2003.

* cited by examiner

*Primary Examiner*—Stephen F. Gerrity
(74) *Attorney, Agent, or Firm*—Finnegan, Henderson, Farabow, Garrett and Dunner, L.L.P.

(57) ABSTRACT

A method and apparatus for venting a filled bottle closed by a stopper is disclosed. The venting is designed to equalize the pressure between the interior of the bottle and the atmosphere such that the stopper inserted into the filled bottle is not forced out of the bottle by excess pressure in the bottle. The venting may be accomplished by deforming the stopper in the bottle opening to form an air-outlet opening in the region sealed by the stopper and the bottle. The venting may be implemented by a squeezing device arranged on at least one side of the stopper, the squeezing device being active in a direction perpendicular to the central axis of the bottle opening.

30 Claims, 4 Drawing Sheets

Figure 1:
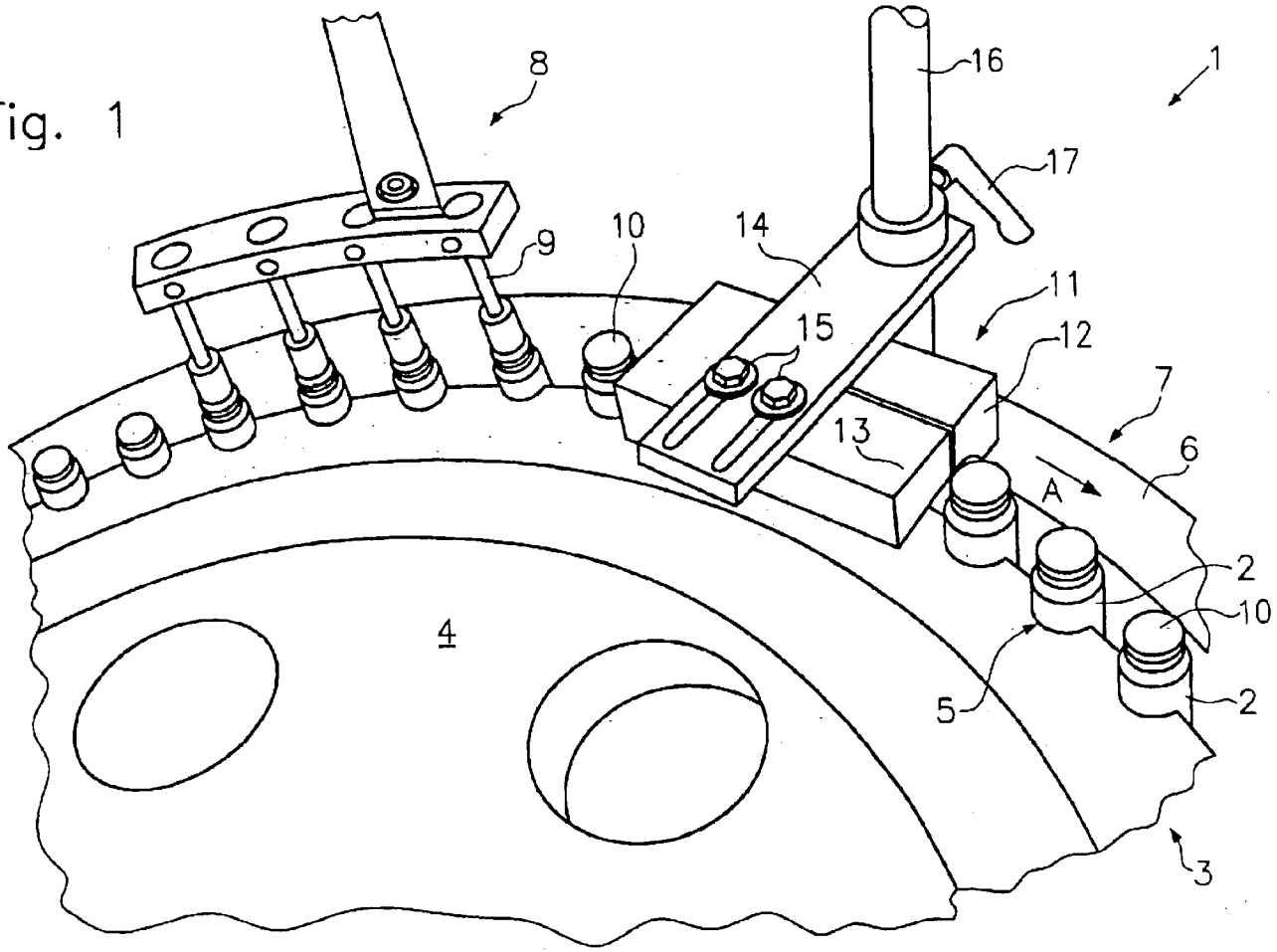

METHOD OF VENTING A FILLED BOTTLE WHICH IS CLOSED BY MEANS OF AN ELASTIC STOPPER, AND APPARATUS FOR IMPLEMENTING THE METHOD

The invention relates to a method of venting a filled bottle which is closed by means of an elastic stopper. The invention also relates to an apparatus for venting a bottle which is closed by means of such a stopper.

The present invention is preferably used for small bottles for bottling pharmaceutical preparations, so-called vials.

When stoppers are positioned on bottles which are filled to a high level, an excess air pressure forms in the bottles. This excess pressure, en route between a stopper-positioning means and a flanging station, forces the stoppers out of the bottles again. These stoppers are consequently located loosely on the bottles. Owing to vibrations as the bottles are transported, stoppers fall into the bottling and packaging machine and cause much disruption there as a result. There is also the risk of the product becoming unsterile. Pressing-down stations, whether equipped with a push rod or with a roller, or else positive guide means are more or less ineffective and even involve new risks. Many stoppers can often be pressed manually into the bottles but are nevertheless forced out of the bottles again.

The elastic stoppers are connected, for example, to an extension of which the diameter is larger than the diameter of the stopper section inserted into the bottle opening. When the stopper has been fully inserted into the bottle opening, the extension butts against the bottle.

It is an object of the present invention to specify a method which is intended for venting a bottle which is closed by means of a stopper and which ensures that the stopper inserted into the bottle is not forced out of the bottle by excess pressure.

The invention proposes a method of venting a filled bottle which is closed by means of an elastic stopper, where the stopper inserted into the bottle opening is deformed such that an air-outlet opening is formed in the sealing region of the stopper and bottle.

The invention makes use of the finding that the excess pressure in the bottle which builds, when the stopper is inserted into the bottle, as a result of the high filling level of the bottle can be immediately dissipated by deformation of the stopper and thus the formation of an air-outlet opening between the stopper and bottle, this resulting in pressure equalization between the interior of the bottle and the atmosphere. There are consequently no compressive forces acting in the interior of the bottle which result in the stopper being forced out of the bottle. The problems described above in respect of further packaging of the bottle thus do not occur.

The stopper can be deformed even as it is inserted into the bottle. It would be sufficient, in principle, for the stopper to be deformed only once it has been inserted into the bottle. In the case of automated filling and packaging, however, it is expedient to overlap the stoppering operation and the venting operation. Immediately after the stopper has been fully inserted into the bottle, further packaging of the bottle can take place, for example in a flanging station.

In order to achieve the effect according to the invention, it is sufficient, in principle, to press laterally from one side against the extension projecting out of the bottle. The extension need not be elastic. All that is necessary is for it to be possible for a transverse force to be introduced, via the extension, into the stopper located in the top of the bottle.

The pressed stopper yields laterally because the deformation continues into the bottle and the air-outlet opening is thus formed.

Of course, the stopper may be configured without the extension, in which case the stopper partially projects out of the bottle when the latter is closed.

According to a preferred embodiment of the invention, it is provided that the squeezing forces are introduced into the stopper on sides of the latter which are directed away from one another. The clamping of the stopper which is produced in this way makes it possible, in particular during movement of the bottle with the stopper, to produce defined squeezing characteristics. This applies, in particular, when the bottle with the stopper positioned thereon is transported relative to a venting station and the stopper is squeezed transversely to the transporting direction.

It is also an object of the invention to provide an apparatus which is intended for implementing the method and which is of particularly straightforward construction.

In this context, it is proposed that the apparatus has a squeezing device which is arranged on at least one side of the stopper and is active in a direction parallel to the plane passing through the bottle opening. This squeezing means is arranged in particular on two sides of the stopper which are directed away from one another.

The apparatus according to the invention is used, in particular, in conjunction with a bottling and packaging station for bottles which are closed by means of stoppers, in particular vials which are closed by means of stoppers, in the case of which the operation of pressing the stoppers into the bottles is overlapped by the operation of venting the bottles.

It is regarded as being particularly advantageous if the apparatus has a body with a channel, where the channel is open at the start and at the end, the channel tapers and widens in width, and the width of the channel in its maximally tapered region is smaller than the diameter of the stopper region projecting out of the bottle, and where the lateral flanks of the channel form the squeezing device. During the operation of feeding the bottle with the stopper, the stopper region projecting out of the bottle at the top is consequently moved into the channel cone and squeezed on account of the dimensioning of the tapering channel width. In the adjoining, widening channel section, the squeezing forces are reduced and, finally, eliminated altogether, with the result that the elastic stopper can expand into the original rotationally symmetrical configuration. The body is, in particular, of plate-like design.

The body preferably has the channel on its underside. The body is consequently positioned above a transporting belt or a transporting apparatus for the bottles, and is, in particular, stationary.

A pressure-exerting device integrated into the body for pressing the stopper into the bottle opening is arranged, in particular, in the region of the squeezing device. The pressure-exerting device may be realized particularly straightforwardly in construction terms if the depth of the channel tapers, to be precise starting from the large-width inlet of the channel and extending as far as the tapered-width region of the channel, the minimal-depth region of the channel corresponding to the final insertion position of the stopper in the bottle. As soon as the bottle with the stopper positioned thereon or plugged therein passes into the region of the body, the roof slope of the channel positions the top surface of the stopper and causes the stopper to be pressed into the bottle opening as it is conveyed relative to the body. The channel region in which the minimal channel depth is achieved may then be adjoined by a constant-depth channel section which is arranged parallel to the conveying plane of the bottle. The constant-depth channel section thus causes the stopper to be kept in the position in which it is fully inserted into the bottle opening. In order to ensure that minimal frictional forces act between the stopper and the body, the body should consist of a plastic with sliding properties.

According to an advantageous configuration, it is provided that the body is slit vertically in the longitudinal direction of the channel, the slit terminating at a distance from the start of the channel. If, in the event of disruption, a bottle with stopper cannot be introduced correctly into the channel, that region of the body which acts on the stopper can spring back as a result of the slit arrangement. This prevents the bottles, which usually consist of glass, from breaking.

Figure 2:
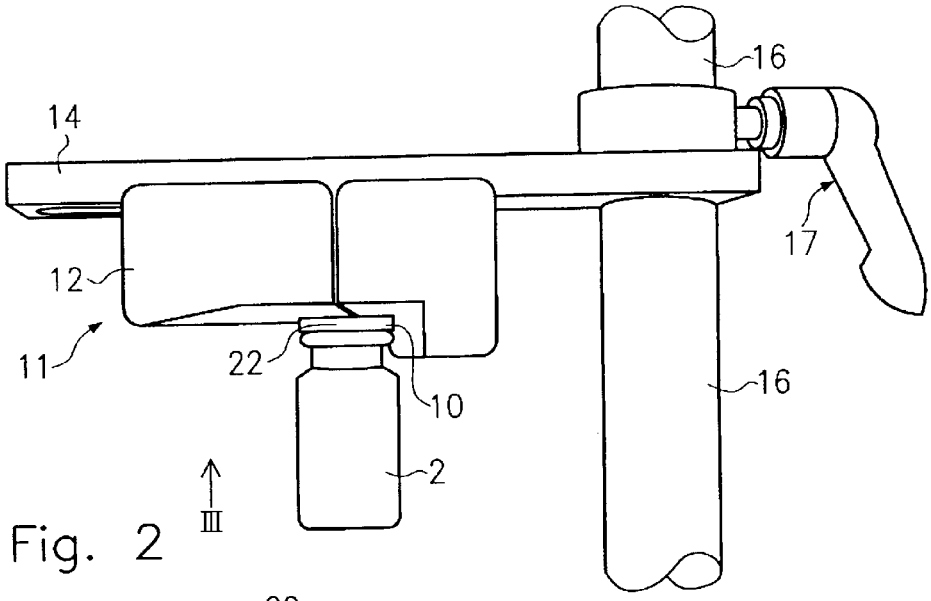
Figure 3:
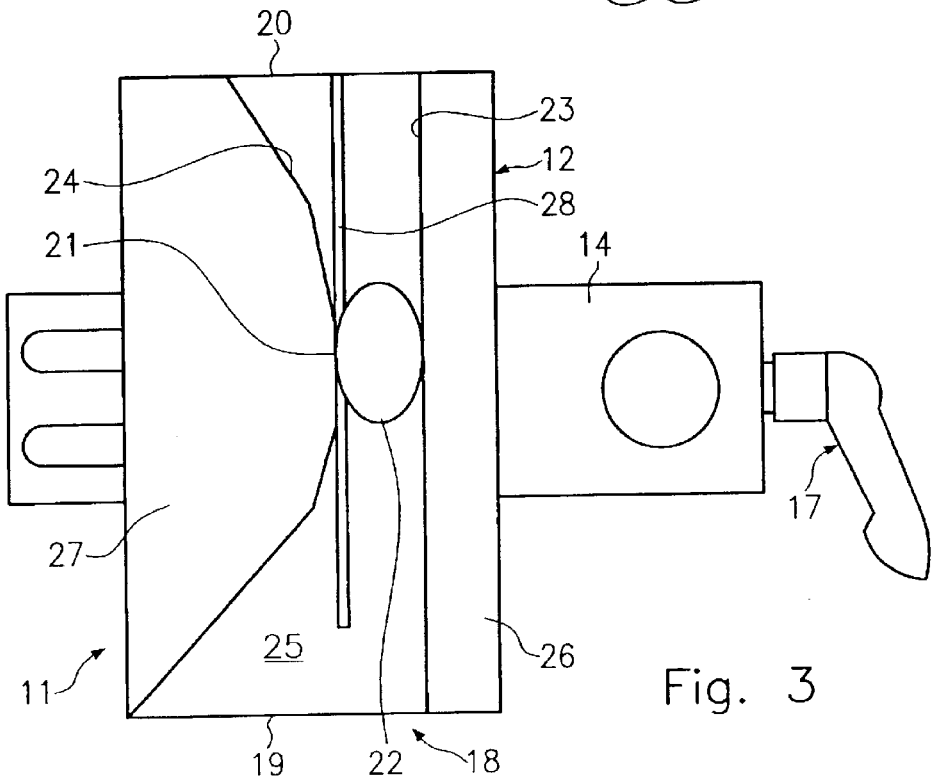
Figure 4:
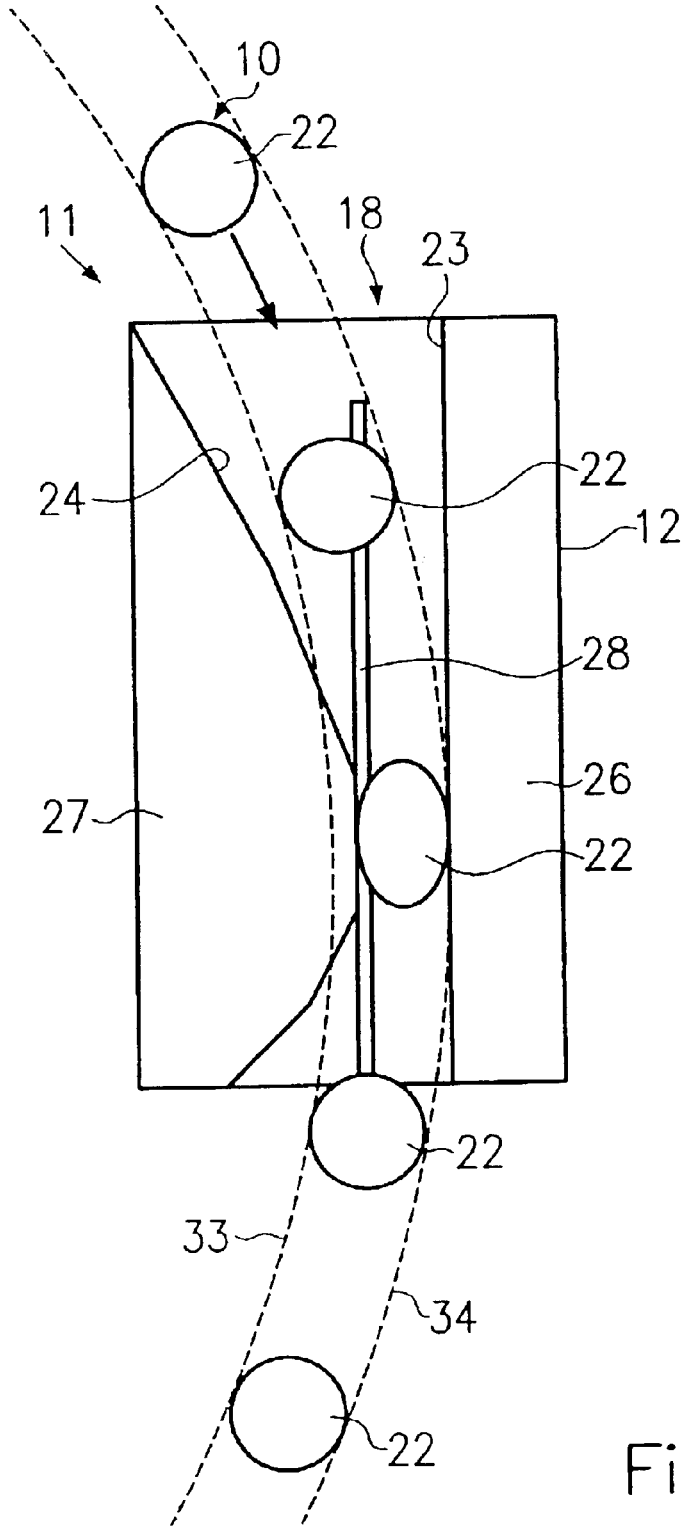
Figure 5:
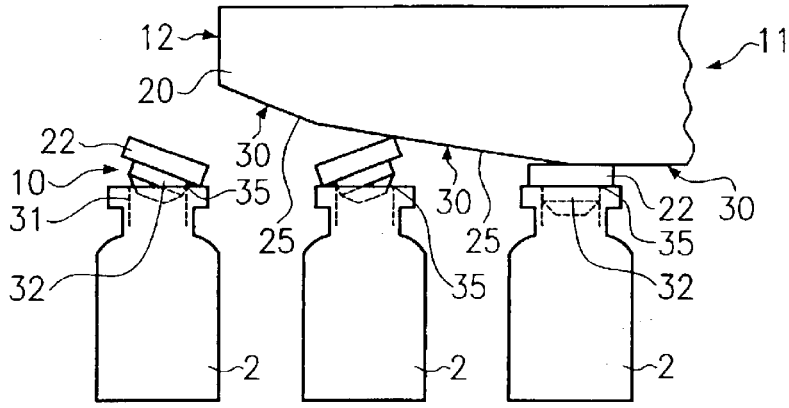
Figure 6:
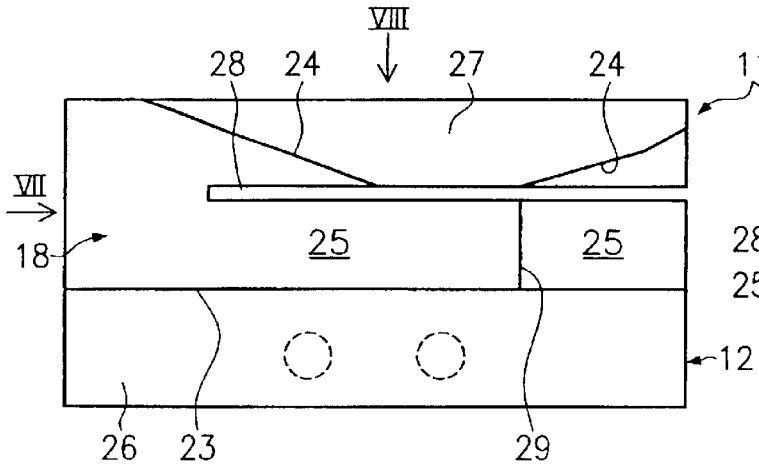
Figure 7:
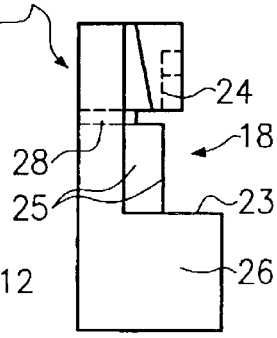
Figure 8:
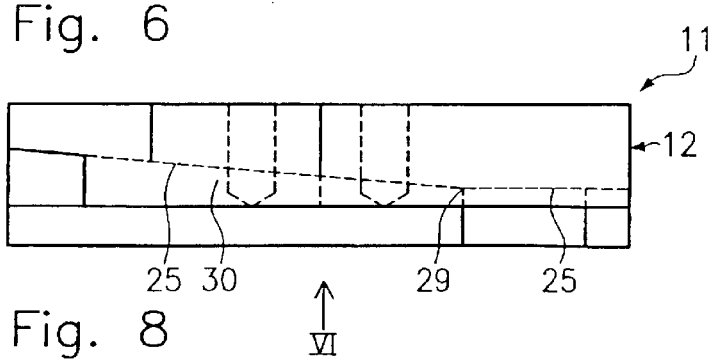

The invention is illustrated in the drawing of the figures by way of an exemplary embodiment, without being restricted to the latter. In the drawing:

FIG. 1 shows a three-dimensional view of part of a bottling and packaging machine in the region of the station for closing filled vials, FIG. 2 shows a side view of the venting apparatus used in the station according to FIG. 1, this being illustrated together with a stoppered bottle, FIG. 3 shows the venting apparatus illustrated in FIG. 2 as seen from beneath in the direction of the arrow III, a squeezed stopper being illustrated in addition, FIG. 4 shows a functional illustration of the venting apparatus corresponding to the illustration in FIG. 3, but as seen from above, FIG. 5 shows a side view of the introduction region of the venting apparatus illustrated for the operation of feeding vials provided with stoppers, FIG. 6 shows a bottom view of the venting apparatus (view according to arrow VI in FIG. 8), FIG. 7 shows a side view of the venting apparatus from FIG. 6 (according to arrow VII in FIG. 6), and FIG. 8 shows a further side view of a venting apparatus from FIG. 6 (according to arrow VIII in FIG. 6).

FIG. 1 illustrates, in the case of a bottling and packaging machine 1 for vials 2, part of a turning ring 3, which is spaced apart from a base plate 4 of the machines. Positioned at uniform angle-sector intervals on the circumference of the turning ring 3 are a multiplicity of vials 2, which stand on the base plate 4 and engage in more or less semicircular recesses 5 of the turning ring 3. A stationary directing element 6, which consists of plastic, encloses the turning ring 3 concentrically, at a distance therefrom, such that the vials 2 are guided between the recess 5 and the directing element 6 with essentially no play in the radial direction. The vials 2 are conveyed in the direction of the arrow A in accordance with the angular speed of the turntable 7 formed from the turning ring 3 and base plate 4.

A device 8, which is arranged above the turntable 7 and has a plurality of push rods 9 which can be moved vertically perpendicularly to the base plate 4, serves for positioning rubber stoppers 10 loosely on the vials 2 located in the region of the push rods 9. Arranged downstream of the device 8 is the venting apparatus 11 according to the invention, this having a profiled body 12 which consists of plastic with sliding properties. The body 12 is arranged above the vials 2 provided with the rubber stoppers 10, and is of planar design on its top side 13. The latter runs horizontally. The body 12 is fastened by a top retaining plate 14 by means of screws 15. The retaining plate 14 is mounted in a vertically displaceable manner in a vertically arranged, stationary rod-like stand 16 and can be fixed at any desired height by means of a clamping element 17 having a clamping screw.

The actual construction of the venting apparatus 11 and the functioning thereof can be seen from FIGS. 2 to 8:

The body 12 has a channel 18 on its underside. This channel is open at its start, illustrated by the end surface 19 of the body 12, and at its end, illustrated by the end surface 20 of the body 12. The channel 18 tapers in width from its start, the maximum tapering being achieved approximately halfway along the length of the channel 18. From there, the channel 18 widens to its end. The width of the channel 18 in its maximally tapered region is smaller than the diameter of the section 22 of the stopper 10, said section projecting out of the vial 2. If the section 22 of the stopper 10 is moved through this region 21 of the channel 18, this results in the deformation of the section 22 which is illustrated in FIGS. 3 and 4. The channel 18 is formed by a radially outer, rectilinear flank 23 and a curved, inner flank 24, in relation to the conveying path of the vials 2. The two flanks 23 and 24 bound outer sections 26 and 27 of the body 12, said sections being raised in relation to the channel base 25. The flanks 23 and 24 form a squeezing device for the sections 22 of the stoppers 10 which are moved along the channel 18.

In the region of its channel base 25, the body 12, starting from the end surface 20, is provided with a slit 28 passing through the body 12. This slit runs parallel to the outer flank 23. The slit 28 terminates at a distance from the other end surface 19, and this distance corresponds approximately to the channel width in the maximally tapered region 21.

It can be gathered from the illustration of FIGS. 5 and 8 in particular that the channel base 25, rather than being planar and horizontal over its length, has one or more sloping introduction sections 30, such that the plate thickness of the body 12 increases, starting from the end surface 20 of the body 12, said end surface being assigned to the introduction region of the vials. The wall thickness of the body 12 in the region of the channel base 25 increases up to the location 29 which, in relation to the conveying direction of the vials 2, is located downstream of the maximally tapered region 21 of the channel 18. The channel base 25 runs horizontally from this location 29. This design of the channel base 25 results in the latter performing the function of a pressure-exerting device, which causes the section 22 of the stopper 10 to be pressed against a top beaded extension 31 of the respective vial 2 and the stopper section 32, which is connected to the section 22, to be introduced into the bottle opening 35 to the maximum extent.

The functional sequence of the rubber stopper 10 being pressed into the respective vial 2 is illustrated in FIG. 5. FIG. 4 shows the overlapping functional sequence of the sections 22 of the rubber stoppers 10 being squeezed. The respective section 22 is deformed, the deformation of the section 22 continuing into the stopper section 32, with the result that an air-outlet opening is formed between the stopper section 32 and the respective vial 2 when the stopper 10 is inserted into the vial 2. This is illustrated indirectly in FIG. 4. The conveying path of the sections 22 of the stoppers 10 is thus illustrated by dashed lines 33 and 34. This figure illustrates that the elliptically deformed section 22 is positioned at a distance from the line 33 in the maximally tapered region 21 of the channel 18. This distance is a reference measure of the deformation of the stopper section 22 on this side of the stopper 10, this resulting in the air-outlet opening formed there between the stopper section 22 and the vial 2.

The vials 2 with the stoppers 10 are transported continuously along the venting apparatuses 11. If, in the event of being conveyed incorrectly, a vial strikes against part of the body 12, the latter can spring back, without the glass breaking, on account of the slit 28 in the body 12.

List of Designations:

1. Bottling and packaging machine
2. Vial
3. Turning ring
4. Base plate
5. Recess
6. Directing element
7. Turntable
8. Device
9. Push rod
10. Stopper
11. Venting apparatus
12. Body
13. Top side
14. Retaining plate
15. Screw
16. Stand
17. Clamping element
18. Channel
19. End surface
20. End surface
21. Region
22. Section
23. Flank
24. Flank
25. Channel base
26. Section
27. Section
28. Slit
29. Location
30. Introduction section
31. Beaded extension
32. Stopper section
33. Line
34. Line
35. Bottle opening

What is claimed is:

1. A method of venting a filled bottle, comprising:

inserting an elastic stopper into a bottle opening;

forming an air-outlet opening in a region sealed by the elastic stopper and the bottle;

transporting the bottle with the elastic stopper in a first direction relative to a venting apparatus; and squeezing the stopper in a second direction transverse to the first direction.

2. The method of claim 1, wherein forming an air-outlet includes deforming the elastic stopper.

3. The method of claim 2, wherein deforming the stopper includes deforming the elastic stopper as it is inserted into the bottle opening.

4. The method of claim 2, wherein deforming the stopper includes deforming the elastic stopper after it has been inserted into the bottle opening.

5. The method of claim 2, wherein inserting the stopper includes inserting the stopper in a first direction, and wherein forming the air-outlet includes squeezing the elastic stopper in a second direction transverse to the first direction.

6. The method of claim 1, wherein inserting the stopper includes inserting the stopper in a first direction, and wherein forming the air-outlet includes squeezing the elastic stopper in a second direction transverse to the first direction.

7. The method of claim 6, wherein squeezing the stopper includes squeezing a portion of the stopper extending outside of the bottle.

8. The method of claim 6, wherein squeezing the stopper includes squeezing substantially opposite sides of the stopper.

9. An apparatus for venting a filled bottle comprising:

means for inserting a stopper into a bottle opening; and means for deforming the stopper to form an air-outlet opening in a region sealed by the stopper and the bottle, wherein the means for deforming is a squeezing device having a body with a channel having a first open end and a second open end, the channel being formed between lateral flanks that taper and widen in width between the first open end and the second open end, the minimum width between the lateral flanks being smaller than a diameter of a portion of a stopper projecting out of a bottle.

10. The apparatus of claim 9, wherein the means for deforming is configured to act on at least one side of the stopper.

11. The apparatus of claim 9, wherein the means for deforming is configured to act on substantially opposite sides of the stopper.

12. The apparatus of claim 9, wherein the lateral flanks are configured to deform the stopper.

13. The apparatus of claim 9, wherein the channel begins tapering at the first open end until the minimum width is reached, widens after the minimum width is reached, and stops widening at the second open end.

14. The apparatus of claim 9, wherein the channel is disposed on an underside of the body.

15. The apparatus of claim 9, wherein the means for inserting is a pressure-exerting device for pressing the stopper into the bottle opening.

16. The apparatus of claim 15, further comprising a means for moving the bottle with the stopper relative to the pressure-exerting device.

17. The apparatus of claim 16, wherein the means for moving the bottle with the stopper moves the bottle with the stopper in an upright position.

18. The apparatus of claim 9, wherein the means for inserting is a pressure-exerting device for pressing the stopper into the bottle opening.

19. The apparatus of claim 18, wherein the pressure exerting device is arranged adjacent to the squeezing device.

20. The apparatus of claim 9, wherein the depth of the channel tapers between the first open end and the region of the channel where the minimum width is reached, the region of the channel where the minimum depth is reached corresponding to a final insertion position of the stopper in the bottle.

21. The apparatus of claim 20, wherein the region of the channel where the minimum depth is reached is adjoined by a constant-depth channel section arranged parallel to a conveying plane of the bottle.

22. The apparatus of claim 20, wherein the portion of the channel that tapers in depth is configured to press the stopper into the bottle opening as the bottle and stopper move relative to the channel.

23. The apparatus of claim 9, wherein the first open end of the channel is a large-width inlet, the channel tapering in depth from the large width inlet until the channel reaches a minimum depth in the region of the channel where the minimum width is reached.

24. The apparatus of claim 23, wherein the region of the channel where the minimum depth is reached is adjoined by a constant-depth channel section arranged parallel to a conveying plane of the bottle.

25. The apparatus of claim 23, wherein the portion of the channel that tapers in depth is configured to press the stopper into the bottle opening as the bottle and stopper move relative to the channel.

26. The apparatus of claim 9, wherein the body is slit vertically in a direction parallel to the longitudinal direction of the channel, the slit terminating before reaching the first open end of the channel.

27. The apparatus of claim 9, further comprising a means for moving the bottle with the stopper relative to the squeezing device.

28. The apparatus of claim 27, wherein the means for moving the bottle with the stopper moves the bottle with the stopper in an upright position.

29. The apparatus of claim 9, wherein the body is made of a plastic material.

30. The apparatus of claim 9, wherein the body is made of a material that minimizes frictional forces between the stopper and the body.

* * * * *